United States Patent [19]

Gordy

[11] Patent Number: 4,467,152

[45] Date of Patent: Aug. 21, 1984

[54] CIRCUIT BREAKER LOCK OUT ASSEMBLY

[75] Inventor: Wade T. Gordy, Jackson, S.C.

[73] Assignee: The United States of America as represented by the United States Department of Energy, Washington, D.C.

[21] Appl. No.: 495,889

[22] Filed: May 18, 1983

[51] Int. Cl.[3] ..... H01H 9/28

[52] U.S. Cl. ..... 200/42 T; 200/44; 70/203

[58] Field of Search ..... 200/42 T, 44, 42 R, 200/334, 321, 327; 70/203, DIG. 30

[56] References Cited

U.S. PATENT DOCUMENTS

| | | | |
|---|---|---|---|
| 2,937,248 | 5/1960 | Michetti | 200/42 T |
| 3,141,933 | 7/1964 | Gauthier | 200/44 |
| 3,678,228 | 7/1972 | Adamson | 200/42 T |
| 4,006,324 | 2/1977 | Leasher et al. | 200/42 T |
| 4,347,412 | 8/1982 | Mihara et al. | 200/42 T |

FOREIGN PATENT DOCUMENTS

| | | | |
|---|---|---|---|
| 765724 | 1/1957 | United Kingdom | 200/42 T |

*Primary Examiner*—John W. Shepperd
*Assistant Examiner*—Renee S. Kidorf
*Attorney, Agent, or Firm*—Allen F. Westerdahl

[57] ABSTRACT

A lock out assembly for a circuit breaker which consists of a generally step-shaped unitary base with an aperture in the small portion of the step-shaped base and a roughly "S" shaped retaining pin which loops through the large portion of the step-shaped base. The lock out assembly is adapted to fit over a circuit breaker with the handle switch projecting through the aperture, and the retaining pin projecting into an opening of the handle switch, preventing removal.

18 Claims, 5 Drawing Figures

FIG. 1
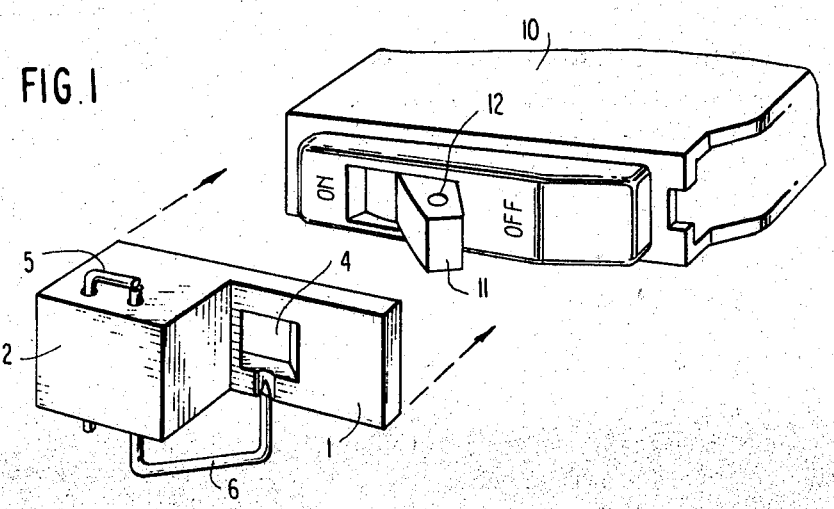
FIG 2
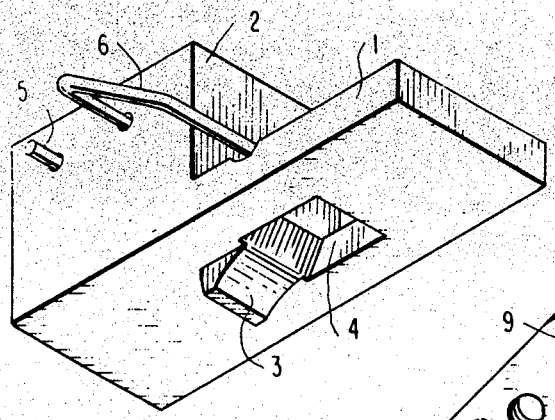
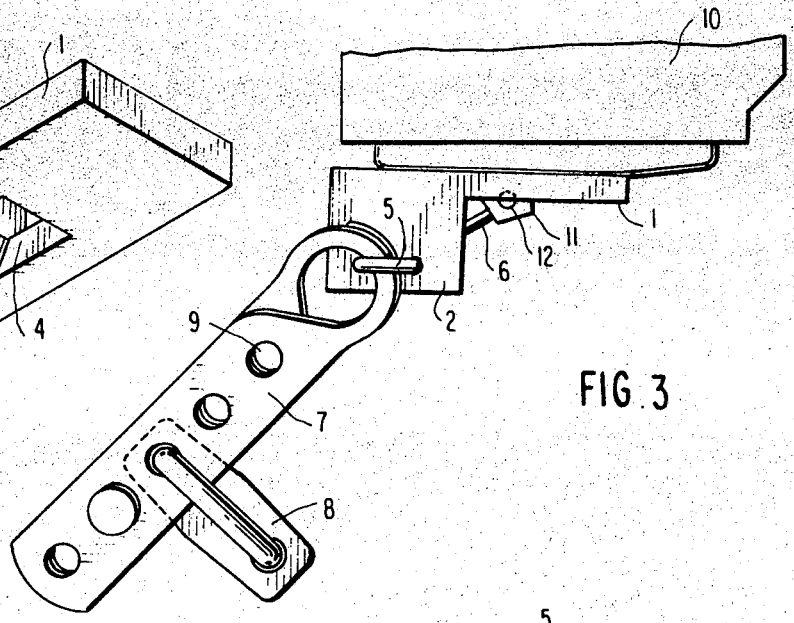
FIG. 3
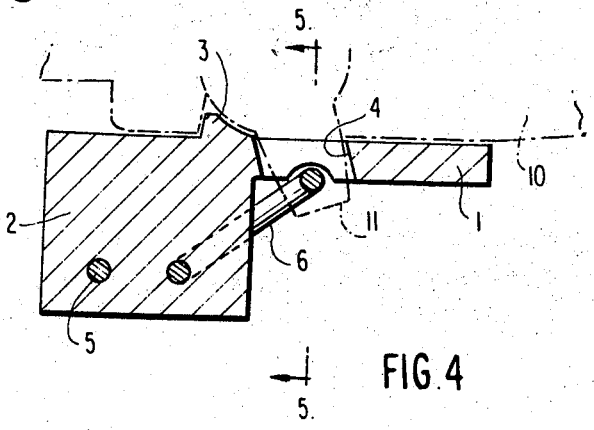
FIG. 4
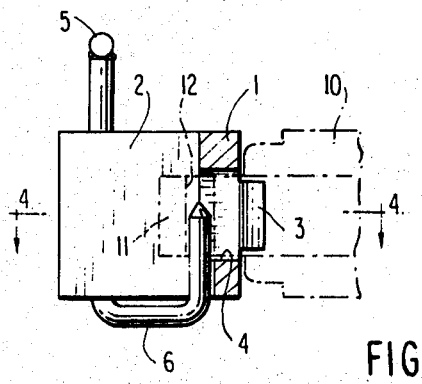
FIG. 5

CIRCUIT BREAKER LOCK OUT ASSEMBLY

BACKGROUND OF THE INVENTION

1. Field of the Invention

This invention relates to a lock out assembly for electrical control devices, such as circuit breaker switches with external operating handles and particularly, to a lock out assembly by which the handle can be locked in one predetermined operating position aided by a conventional padlock, or with a conventional hasp and padlock.

2. Prior Art

There are numerous instances when it becomes necessary to assure that one or more circuit breakers in a panel board be inoperable, while at the same time the remaining circuit breakers be freely operable for both the open and closed positions. This is accomplished by providing individual circuit breakers with some type of lock out device. The lock out device is positioned to block movement of the circuit breaker handle in either its "on" or "off" position. It is required that the lock out device be secured in such a manner that an unauthorized person cannot readily remove or otherwise tamper with the lock out device to defeat its intended purpose.

Many of the prior art implements provide a lock out device for a circuit breaker used in field installations. However, lock out devices for field installation require removal of the panel board front cover plate for installation of the lock out device on the desired circuit breakers. Other prior art implements comprise lock out devices which fit over or around the circuit breaker handle, but can be pried loose from the handle with little effort, defeating the intended purpose of the lock out device. Still other lock out implements are not universally adaptable insofar as they require special grooves or inserts in the circuit breaker.

U.S. Pat. No. 3,291,924 discloses a locking device for a circuit breaker handle including employment of a padlock. However, the locking device depends upon biting edge 25 to prevent the device from being pried loose from the handle. Because most handles are tapered, the outer most portion of the handle is narrower than the base portion of the handle and the locking device can easily be pried loose off even when "locked" in position.

U.S. Pat. No. 3,376,400 discloses a locking device for a circuit breaker handle which also includes a padlock. However, the locking device possesses tongues 33 and 35 that insert into the circuit breaker. This requires the circuit breaker to have a specific shape which defeats universal application of the device.

U.S. Pat. No. 3,678,228 also discloses a locking device for a circuit breaker handle, including a padlock. The locking device is similar in nature to U.S. Pat. No. 3,376,400 described above because the device comprises two tongues which only fit specific shaped circuit breakers.

U.S. Pat. No. 4,160,137 shows a circuit breaker with a locking device for the handle, including a padlock. The locking device is a two part device, each part having one curved portion. One portion of the device is slipped over the circuit breaker handle while the other portion is fastened to the first portion by means of screws. The locking device fits a specific shaped circuit breaker having undercut grooves adapted to receive the curved portions of the locking device. Again, the device is limited to specific shaped circuit breakers.

U.S. Pat. No. 4,260,861 shows a circuit breaker with a locking device including a padlock. The locking device comprises a three piece unit which is only adaptable to a specific type circuit breaker. Two hook like projections secure the locking device to corresponding indents of the circuit breaker.

None of the above addressed prior art implements are acceptable because: (1) either they do not work since they can be pried loose, or; (2) they are not universally adapted to the conventional circuit breaker. Moreover, some of the above addressed prior art implements are multi-piece items which require assembly time. Also, further delays result if any pieces become lost. Thus, a need exists for a one piece lock out assembly, universally adaptable for conventional circuit breakers, which cannot be pried loose once locked into position.

SUMMARY OF THE INVENTION

In order to overcome the foregoing disadvantages of the prior art lock out implements, the present invention provides a lock out assembly which does not require circuit breakers to be constructed with special formations or grooves, and which are engaged to secure the lock out assembly to the circuit breaker. The instant invention provides a handle lock out assembly which is secured to the circuit breaker housing merely by taking advantage of the fact that the circuit breaker is provided with a manual operating handle. In particular, the handle lock out assembly of the present invention is universally adaptable to accommodate conventional type circuit breakers manufactured by such companies as General Electric, Westinghouse and Square D.

The principle object of the present invention is to provide a handle lock out assembly attachable to the casing of a single pole, molded-case circuit breaker in an electrical panel board, wherein the lock out assembly is capable of selectively receiving the shackle of a padlock, or a hasp and padlock, to lock the handle of the circuit breaker in either the on or off position. Moreover, the lock out assembly must be sized and shaped to fit substantially within the confines of the panel board and must be capable of receiving a padlock or a hasp and padlock in a manner that does not interfere with adjacent circuit breakers in the panel board.

It is another object of the present invention to provide a simple, fail-safe and inexpensive locking device to prevent movement of the circuit breaker handle by providing a unitary lockout device that requires no additional elements to couple the lock out device to the circuit breaker handle.

It is another object of the present invention to provide a lightweight circuit breaker lock out assembly which mounts on top of circuit breaker handle and is fully engaged with the circuit breaker by merely sliding a retainer pin through the hole in the circuit breaker handle.

Other features, objects and characteristics of the present invention will be more fully described in referring to the drawing and detailed description set forth below.

BRIEF DESCRIPTION OF THE DRAWING

FIG. 1 is a fragmentary perspective view of a circuit breaker having a handle lock out assembly constructed in accordance with the present invention for mounting on the circuit breaker handle.

FIG. 2 is a perspective view of the lock out assembly.

FIG. 3 is a fragmentary side view showing a circuit breaker with the lock out assembly mounted thereon and a hasp and padlock attached to the lock out assembly to prevent removal.

FIG. 4 shows an enlarged fragmentary side view of the lock out assembly attached to a phantom circuit breaker handle.

FIG. 5 shows a sectional view of FIG. 4 along line 5—5 to further illustrate the position of the lock out assembly mounted on the phantom circuit breaker.

DETAILED DESCRIPTION OF THE PREFERRED EMBODIMENTS

Referring to the figures of the drawing, there is shown a circuit breaker lock out assembly comprising a step-shaped unitary base with a small portion 1, a large portion 2 and an integral retainer pin 5, 6.

The retainer pin initially comprises portion 5 and portion 6. Once these portions are positioned with respect to the base, the portions are welded together at their junction, creating one roughly "S" shaped integral retainer pin. The retainer pin can be made of any weldable material such as iron, steel and other metals or plastics.

The small portion 1 of the breaker lock out assembly has an aperture 4 which extends entirely through the small portion and is directed away from the larger portion at approximately a 20° angle with respect to the bottom surface of the base (the bottom surface being the surface mating the circuit breaker as illustrated in FIGS. 3 and 4). The aperture 4 is roughly square and sized to accept a typical conventional circuit breaker handle 11. The circuit breaker handle extends substantially beyond the upper surface of the small portion, allowing the retainer pin access to slide into and fully engage the orifice 12 within the circuit breaker handle.

The bottom surface of the base includes a projection 3 positioned substantially entirely under large portion 2, but adjacent the junction of the large portion and small portion and bordering aperture 4. The projection 3 is slightly narrower than the adjacent side of square aperture 4 as shown in FIG. 5. The face of projection 3 adjacent aperture 4 curves concavely toward the apex of projection 3, and then angles sharply to the bottom surface as shown in FIGS. 2 and 4.

The small portion of the base can include a semi-circular groove on the upper surface extending between a side of the lock out assembly and one side of aperture 4 as shown in FIGS. 1 and 4. This groove allows the retainer pin 5, 6 access to fully engage orifice 12 in the circuit breaker handle. Of course, the semi-circular groove is not necessary if the small portion is made even smaller, such that orifice 12 in the circuit breaker handle extends entirely above the upper surface of the small portion. On the other hand, if a heavy duty lock out assembly is deemed necessary, the smaller portion can be thickened, such that a semi-circular groove is required.

The circuit breaker lock out assembly can be made of any strong lightweight material such as aluminum, graphite, fiberglass, nylon, or any suitable plastic. However, because the lock out assembly is somewhat small in size, heavier materials can also be employed such as iron or steel. In actuality, the weight of the lock out assembly is only limited by the amount of weight the circuit breaker and corresponding handle can support.

In operation, the breaker lock out device is positioned over the circuit breaker 10 such that handle 11 protrudes through aperture 4 of the lock out assembly. Once the handle of the circuit breaker extends through orifice 4, retainer pin 5, 6 can slide into orifice 12 of the handle. Projection 3 of the breaker lock out device fits neatly into the handle opening of the circuit breaker adjacent the base of the handle as shown in FIG. 4. Because retainer pin 5, 6 prevents the lock out assembly from being lifted and projection 3 prevents longitudinal and lateral movement of the lock out assembly, the circuit breaker can not be switched.

As shown in FIG. 3, a hasp 7 secures the breaker lockout device by preventing movement of the retainer pin which prohibits the lockout device from being disassembled and removed from the circuit breaker. The conventional hasp includes several openings sufficiently large for a padlock 8 to be inserted in one or more of the openings. The hasp is not meant to be a part of the present invention.

The shape and design of the lock out assembly is significant from several perspectives. Retainer pin 5, 6 forms a loop where portion 5 and 6 are welded such that the hasp and padlock can be inserted through the loop. As clearly shown in FIG. 3, the large portion 2 of the lock out assembly is of such dimensions as to enable the hasp to extend through the loop of the retaining pin without contacting the circuit breaker or panel board. Furthermore, the dimensions of the large portion 2 also permit the hasp to be movable thus allowing one to orient the hasp and padlock in a direction permiting access to the padlock. A plurality of lockout assemblies can be employed in a circuit breaker panel board without interfering with the circuit board and without interfering with one another because of the unique shape and design.

A typical industrial use of such a breaker lock out device would be a nuclear power plant which must proceed through a series of inspections before certified for operation. One method of controlling inspections of apparatus is to place the lock out assembly with hasp and padlocks upon the particular circuit breaker involved. Each hole of the hasp includes a padlock and the number of padlocks correspond to the number of inspections, allowing each inspector to remove one padlock from the circuit breaker when the inspection is complete. When all inspectors have completed all inspections, all padlocks will have been removed and the system can be placed into operation. Furthermore, the key of each inspector will only unlock one specific padlock, preventing accidental removal before final inspection. In this instance, the circuit breaker is locked in the "off" position.

Another typical situation in which the lockout assembly can be employed, occurs in a conventional building alarm system. In such an instance, it may be desirable to provide the alarm circuit breaker with a lock out assembly such that the circuit breaker can always provide the necessary power to the alarm system. In this instance, the alarm circuit breaker is locked in the "on" position.

The most obvious use of the lockout assembly occurs when maintenance is necessary for a particular apparatus or system. The lock out assembly could be employed to lock the circuit breaker with "off" position while work is progressing.

From the above situations, it is apparent that the lock out assembly can lock the circuit breaker handle in either the "on" or the "off" positions as desired.

Generally, circuit breakers are positioned horizontally and stacked vertically upon one another in a panel board. When the lock out assembly is positioned over the handle of the circuit breaker it is often difficult to determine whether the circuit breaker is locked "on" or "off". This situation can easily be overcome by providing the lockout assembly with a decal which reads "on" and "off". The words "on" and "off" are vertically positioned one above the other, but upside down from each other. When the lock out assembly locks the circuit breaker in the "off" position, the decal reads "off". When ever it is desired to lock a circuit breaker into the "on" position, the lockout assembly must be rotated 180° and the decal now reads "on". Thus, one word on the decal will be right side up, and the other word will be upside down making it easy to determine whether the lock out device has locked the circuit breaker in the on or off position. Which ever word is readable (right side up) is the position in which the lockout assembly has positioned the circuit breaker switch.

Some panel boards mount circuit breakers in a vertical position. However, the lockout assembly must still be reversed in order to lock the circuit breaker in the opposite position. Thus, even in the vertical position, a decal could read "off" or "on" as described above.

Of course, decals can be misplaced, ripped or torn from the lock out assembly, or even positioned upside down making it difficult once again to determine what-what position the circuit breaker has been locked into. This can be remedied by engraving the lock out assembly itself with the words "on" and "off" in the same manner indicated in describing the decals.

What is claimed is:

1. A lock out assembly comprising: a generally step-shaped unitary base with an aperture in a small portion of the step-shaped base; and a roughly "S" shaped retaining pin which loops through a large portion of the step-shaped base whereby the lock out assembly is adapted to fit on a circuit breaker with a switch handle projecting through the aperture, and the retaining pin projecting into an opening of the switch handle, preventing removal.

2. The lock out assembly of claim 1, further including a projection on a surface which mates with the circuit breaker and is positioned adjacent the aperture, whereby the projection fits within the switch handle opening of the circuit breaker, preventing lateral and longitudinal movement.

3. The lock out assembly of claim 1, wherein a semicircular groove is cut into an upper surface of the small portion of the step-shaped base, which groove extends from a side of the unitary base to a side of the aperture.

4. The lock out assembly of claim 1, wherein the roughly "S" shaped retainer pin forms an opening with the unitary base of sufficient size to accomodate a padlock or a hasp and padlock.

5. The lock out assembly of claim 1, wherein said retainer pin is made of metal or plastic which can be fused together.

6. The lock out assembly of claim 1, wherein the base is made of any lightweight material, such as aluminum, nylon, fiberglass or any suitable plastic.

7. A lock out assembly for a circuit breaker having a switch handle comprising: a generally step-shaped base with an aperture in a lower portion of the base and a roughly "S" shaped retaining pin through an upper portion of the base, wherein said step-shaped base is adapted to fit over said circuit breaker with the switch handle extending through said aperture, and wherein said retaining pin is adapted to slide into an orifice in the handle switch thus preventing movement of the switch handle.

8. The lock out assembly of claim 7, further including a projection on a bottom surface of the lock out assembly which mates with the circuit breaker and is positioned adjacent the aperture.

9. The lock out assembly of claim 7, wherein a semicircular groove is cut into an upper surface of the lower portion of the step-shaped base, which groove extends from a side of the base to a side of the aperture.

10. The lock out assembly of claim 7, wherein the roughly "S" shaped retainer pin forms an opening with the base of sufficient size to accomodate a padlock or a hasp and padlock.

11. The lock out assembly of claim 7, wherein said retainer pin is made of metal or plastic which can be fused together.

12. The lock out assembly of claim 7, wherein the base is made of any lightweight material, such as aluminum, nylon, fiberglass or any suitable plastic.

13. A safety lock out assembly for an electrical circuit breaker comprising the combination of a circuit breaker, including a switch handle having a transverse orifice therein; and a unitary step-shaped base, with a lower portion of the step-shaped base including an aperture, an upper portion of the step-shaped base including a retaining pin, wherein said lock out assembly mounts upon the circuit breaker with the handle projecting through said aperture allowing said retaining pin to project within said transfer orifice.

14. The lock out assembly of claim 13, further including a projection on a bottom surface of the lockout assembly which mates with the circuit breaker and is positioned adjacent the aperture.

15. The lock out assembly of claim 13, wherein a semicircular groove is cut into an upper surface of the lower portion of the step-shaped base, which groove extends from a side of the base to a side of the aperture.

16. The lock out assembly of claim 13, wherein the roughly "S" shaped retainer pin forms an opening with the base of sufficient size to accomodate a padlock or a hasp and padlock.

17. The lock out assembly of claim 13, wherein said retainer pin is made of metal or plastic which can be used together.

18. The lock out assembly of claim 13, wherein the base is made of any lightweight material, such as aluminum, nylon, fiberglass or any suitable plastic.

* * * * *